US005800870A

United States Patent [19]

Luebke et al.

[11] Patent Number: 5,800,870

[45] Date of Patent: Sep. 1, 1998

[54] SIZE PRESS COATING METHOD

[75] Inventors: Gary Luebke, Olathe, Kans.; Edward P. Pauley, Jesup, Iowa

[73] Assignee: Penford Products Co., Cedar Rapids, Iowa

[21] Appl. No.: 811,130

[22] Filed: Mar. 3, 1997

[51] Int. Cl.[6] ..... B05D 7/04; D21F 7/00

[52] U.S. Cl. ..... 427/369; 427/391; 427/395; 162/136; 162/196

[58] Field of Search ..... 427/369, 391, 427/395; 162/135, 136, 137, 196

[56] References Cited

U.S. PATENT DOCUMENTS

| | | | |
|---|---|---|---|
| 4,375,535 | 3/1983 | Kightlinger et al. | 527/313 |
| 4,552,940 | 11/1985 | Van Eenam | 527/312 |
| 5,003,022 | 3/1991 | Nguyen et al. | 527/300 |
| 5,130,395 | 7/1992 | Nguyen et al. | 527/300 |
| 5,416,181 | 5/1995 | Nguyen et al. | 527/300 |
| 5,536,764 | 7/1996 | Nguyen et al. | 524/53 |

OTHER PUBLICATIONS

"Cracking at the fold," in *Paper Focus*, pp. 28, 30–31 (1991).

Guyot, C. et al., "Folding Resistance of Magazine Papers," *Tappo Proceedings*, pp. 255–268 (1992).

Jopson, R.N. et al., "Surface Engineering for Conversion Quality in Coated Products," *Tappi Proceedings*, pp. 449–459 (1992).

Jopson, R.N. et al., "Improving Fold Quality in Coated Papers and Boards–The Relationship Between Basestock and Coating," *Tappi Proceedings*, pp. 459–477 (1995).

Klass, C.P., "Film Transfer Size Presses–Versatile Tools for Surface Chemical Treatment and New Grade Development," *PaperAge*, pp. 12–14 (1994).

Valmet, "Valmet Sym–Sizer" *Valmet Paper Machinery Inc.*, Finland, pp. 2–8 (1994).

*Primary Examiner*—Erma Cameron

*Attorney, Agent, or Firm*—Marshall, O'Toole, Gerstein, Murray & Borun

[57] ABSTRACT

The invention provides an improved method of coating mediumweight and heavyweight papers in a size press by applying a paper coating composition comprising a binder wherein the binder comprises a stable aqueous dispersion comprising a water insoluble component and a water soluble component such that the water insoluble component comprises coalescable polymer particles which have a $T_g$ less than 55° C. and a majority of which have a particle size less than 1 micron; and the water soluble component comprises a water soluble polymer capable of inhibiting coalescence of said polymer particles, or a water soluble polymer and a component capable of inhibiting coalescence of said polymer particles; and wherein said water insoluble component comprises greater that 3% and less than 75% by weight of the binder solids and said water soluble component comprises greater than 25% and less than about 97% of said solids.

15 Claims, No Drawings

SIZE PRESS COATING METHOD

BACKGROUND OF THE INVENTION

The present invention relates generally to coated papers and specifically to methods for coating mediumweight and heavyweight papers with a size press coating apparatus.

Coated papers can be produced using many different methods. In the most frequently used method, a liquid coating composition is applied to the surface of a base paper. Excess coating, if present, is removed and the paper and coating are dried together. This may optionally be followed by application of additional coating layers using the same or different methods, or by one or more surface finishing steps. The most common apparatus used to produce coated paper is a trailing blade coater, in which the wet, coated paper is carried by a backup roll under the tip of a stationary, thin blade to remove the excess liquid coating. This is normally done in a continuous operation to one side of paper at a time, each time followed by drying. The use of trailing blade coaters is particularly common in the production of lightweight coated a typical basis weight of about 35 pounds per 3,300 square feet for paper used in magazines and a basis weight of about 50 pounds per 3,300 square feet for conventional office and copy paper. (According to this case, basis weights will be presented on the basis of 3,300 square feet). Many other methods are known and practiced in the art.

Size presses can also be used to apply coatings. Their use is characterized in nearly all cases as an on-line method, in which the size press is an integral part of the paper machine. This is in contrast to off-machine methods such as blade coating, in which a roll of pre-made paper is fed into a coating apparatus. Size press coating can be particularly effective as it can treat both sides of the base paper simultaneously. It is also convenient to use a size press to apply a precoat, or preparatory coating, to paper to prepare its surface for subsequent on- or off-machine coatings. Nevertheless, because it is an on-line application, any problem which interferes with operation of the size press has the potential to interfere with operation of the entire paper machine. Runnability considerations at the size press are thus very important in maintaining maximum productivity. Coatings which provide good coated paper properties but run poorly may be rejected for use in production due to poor runnability and low machine efficiency.

Coated paper is frequently printed and then folded either to form a pamphlet or brochure, or to prepare it for binding into a book or magazine. Medium and heavy weight coated papers, characterized as having basis weights of approximately 60 pounds or more per 3,300 square feet, tend to suffer from the tendency to crack at their folded edge. This is particularly the case with heavier paper stocks and stocks carrying high coat weights. Such cracking can occur either at the time of folding or sometime thereafter. This cracking at the fold is a quality defect, the seriousness of which ranges from a simple crack in the coating along the fold, to a separation of the paper. An unsightly white line, visible through a film of printed ink, is mainly an aesthetic problem. In a brochure, the crack might be felt as a rough or jagged edge along the fold line. Separation is much more serious and can cause one or more of the pages in a booklet to detach from the binding and fall out, especially in metal stitched or stapled books and magazines. The problem of cracking at the fold is well known to printers and paper manufacturers. From a papermaker's point of view complaints related to poor appearance of printed material due to cracks or magazines which gradually fall apart can result in costly loss claims because the cracking may occur after paper is coated, printed, and bound. The papermaker can thus be liable for the cost not only of his own paper, but also for costs associated with subsequent printing and binding.

Printers have thus attempted to address the issue of cracking at the fold in a number of ways as set out, for example, in Paper Focus, pp 28–31 (December 1991); Guyot et al., TAPPI Proceedings pp. 255–268 (1992); Jopson, TAPPI Proceedings pp. 449–459 (1992); and Jopson et al., TAPPI Proceedings pp. 459–477 (1995). Such methods include the use of an on-press remoisturizing system by the printer to compensate for the desiccating effect of high temperature dryers utilized on high speed, heat set printing presses. Alternatively, the folding system could be modified to reduce the stress placed on the folded edge during the folding operation. Thus, heavier weight sheets are commonly prescored or creased along the fold line to facilitate a clean fold. Nevertheless, these processes all increase the complexity and cost of the printing operation. Thus, there remains a desire in the art for mediumweight and heavyweight papers which are capable of folding cleanly without the need for remoisturizing, scoring or other treatments because such papers would offer the printer an opportunity to reduce costs and increase production.

Efforts by papermakers to improve the fold behavior of coated paper have met with limited success, either for reasons of economics or because of the challenge of maintaining a balance of competing performance properties. It is important that modifications made to paper or paper coatings maintain the printing performance of the paper including properties, such as gloss, ink receptivity, and pick resistance. Many methods adopted by papermakers for improving crack at the fold behavior involve making changes in ingredients, such as coating pigments and binders, or fibrous additives, used in the papermaking and coating processes. Nevertheless, such changes tend to have an adverse influence on desirable paper properties, cost, or production speed.

Efforts directed to modification of paper coating compositions have met with only limited success in addressing the issue of foldability of mediumweight and heavyweight coated paper. Paper coating compositions typically comprise a pigment which can be clay, titanium dioxide and the like, and a binder for the pigment such as starch or a synthetic latex. While substitution of latex binders for starch-based binders in paper coating compositions provides more strength and flexibility than conventional starch-based binders, and would be expected to reduce the tendency to crack at the fold, the substitution can lead to runnability and productivity problems, especially when the coating is being applied at a size press. The runnability problems are caused, in part, by a loss in stability of latex materials when exposed to the environment at the size press, or when contact of the freshly coated, wet sheet is made with a hot surface such as steam-heated drying cylinders used on a paper machine. Replacement of starch with latex can also alter other physical properties of paper such as porosity, which may lead to blistering of the sheet during high intensity drying. As a result, replacement of starch with latex binders as a route to improved fold performance has found only limited use in coating, particularly in size press coating which is used in the coating of mediumweight and heavyweight papers.

Of interest to the present invention are the disclosures of styrene/butadiene-starch copolymers manufactured as described in U.S. Pat. No. 5,003,022, and that of the styrene/butadiene containing stable aqueous dispersions capable of forming reinforced film structures described in U.S. Pat. No. 5,416,181. These patents disclose the use of paper coating compositions in light weight coating applications such as on blade coaters but do not disclose or suggest the use of such materials on heavier weight stock or for use on size presses which can constitute a more demanding environment than do light weight coaters for the synthetic components of such coating compositions. Also of interest is the disclosure of Nguyen et al., U.S. Pat. No. 5,536,764 which relates to cationic starch/vinyl acetate containing board coating binders which are characterized by improved pigment binding strength and allow the replacement of proteins such as soy proteins and casein typically used as binders in such formulations.

Accordingly, there remains a need for improved methods of providing improved crack at the fold properties for mediumweight and heavyweight papers coated in a size press apparatus without adversely affecting other important paper properties or productivity of the papermaking operation.

SUMMARY OF THE INVENTION

The present invention provides improvements in methods of coating mediumweight and heavyweight papers characterized by a basis weight greater than 60 pounds per 3,300 square feet in a size press by applying a paper coating composition comprising a binder and optionally a pigment. Specifically, the improvement comprises the use of a binder which comprises a stable aqueous dispersion having a water insoluble component and a water soluble component wherein: (a) the water insoluble component comprises coalescable polymer particles which have a $T_g$ less than 55° C. and a majority of which have a particle size less than 1 micron; and (b) the water soluble component comprises a water soluble polymer capable of inhibiting coalescence of said polymer particles, or a water soluble polymer and a component capable of inhibiting coalescence of said polymer particles; and wherein said water insoluble component comprises greater that 3% and less than 75% by weight of the binder solids and said water soluble component comprises greater than 25% and less than about 97% of said solids.

Suitable binder components of the coating composition include those described as styrene/butadiene-starch copolymers in U.S. Pat. No. 5,003,022, and as stable dispersions capable of forming reinforced films in U.S. Pat. No. 5,416,181 the disclosures of which are hereby incorporated by reference. It has been found that use of these materials as binders in size press coating compositions provide surprising improvements in reducing the tendency of mediumweight and heavyweight size pressed papers to crack at the fold while maintaining other desirable properties of size pressed paper. This is surprising because it might have been expected that the rather demanding physical environment of a size press would cause the styrene-butadiene components of these materials to lose stability.

According to a preferred aspect of the invention, the binder composition comprises the reaction product of monomers making up the water insoluble component in the presence of starch. A particularly preferred component comprises the persulfate ion initiated reaction product of styrene and 1,3-butadiene in the presence of starch. Alternatively, the binder can comprise a blend of the water insoluble component such as a styrene-butadiene latex with the water soluble component such as starch wherein the water insoluble component is capable of inhibiting coalescence of the synthetic polymer particles. The water soluble polymer is preferably a hydrolyzed starch and most preferably is a starch hydrolyzate product having an intrinsic viscosity of less than 0.12 dl/g when measured at standard conditions.

The results exhibited by the methods of the invention are surprising as one skilled in the art would anticipate that the starch component of these materials would affect crack at the fold tendency adversely, as normal starch-based binders would. Moreover, the styrene-butadiene component of these materials might be expected to cause runnability and productivity problems on size presses as exhibited by the use of styrene-butadiene lattices in the past. Instead, it has been found that size press application of these materials to mediumweight and heavyweight paper, which is defined herein as paper having a basis weight of greater than 60 pounds, in aqueous clear (unpigmented) or pigmented size press coating formulations provides improved crack at the fold properties to the coated paper. The effect is such that measures ordinarily carried out on mediumweight weight size pressed papers to minimize the tendency to crack at the fold such as scoring and creasing may often be eliminated providing cost and efficiency advantages to the printer. Thus, paper which resists cracking at the fold offers a papermaker two advantages. Not only can the likelihood of customer complaints be reduced, but the papermaker can also enter the market with a higher value-added grade of paper.

Further, application of these materials in size press coating formulations does not generally adversely affect other desired paper properties important to printers, such as gloss, ink holdout, opacity, and pick resistance. Moreover, it is possible to combine these materials into high solid content coating formulations having solids contents of 40% and greater and 50% and greater which run well and maintain machine productivity in size press equipment. When used with pigment, these materials are compatible with high solids, low binder content formulations, which are highly cost effective.

DETAILED DESCRIPTION OF THE INVENTION

Preferred binder materials useful in practice of the present invention are styrene/butadiene-starch copolymers manufactured as described in U.S. Pat. No. 5,003,022, and the stable aqueous dispersions capable of forming reinforced film structures as described in U.S. Pat. No. 5,416,181. These patents disclose paper coating compositions for use in light weight coating applications utilizing trailing blade coaters but do not disclose the use of such materials on size presses for for use on heavier weight stock. A particularly preferred binder is the product commercially available from Penford Products Company, Cedar Rapids, Iowa as Pensize® 630 binder. This composition comprises 30% solids and is the product of a persulfate ion initiated reaction of styrene and 1,3-butadiene monomers in the presence of a thin, lightly oxidized hydroxyethyl starch which has an intrinsic viscosity of about 0.23 dl/g at standard conditions wherein the styrene to butadiene ratio is 60/40 by weight and the synthetic to starch ratio is 40/60 by weight. Other commercial products expected to be particularly useful in practice of the invention include but are not limited to PENGLOSS® 110, PENGLOSS® 115, PENGLOSS® 150, XPG-318, PAF 3830 and Pensize® 640 binders available from Penford Products Co. and which have solids levels as high as 50%, synthetic to starch ratios ranging from 40/60 to 60/40 and styrene to butadiene ratios ranging from 60/40 to 70/30.

As well as providing the advantage of reducing the tendency to crack at the fold, these materials provide attractive properties to coating formulations and facilitate the use of high solids contents. They provide excellent runnability and resistance to thermal, chemical, and shear breakdown. This is in surprising contrast to commercial styrene-butadiene lattices which provide high binding power but have less resistance to breakdown during the size press coating operation. Results of such styrene-butadiene binder breakdown include sticking on the size press, streaking of the coating, and deposits of dried scale and debris on hot dryer can surfaces in the after-size press drying section of the paper machine. These effects interfere with paper machine productivity and result in higher than normal maintenance costs. The materials of the invention provide good runnability and machine productivity, improved binding strength relative to starch, and do not require cooking in the preparation step.

Methods of the invention comprise use of the described binder materials in the size press coating of mediumweight and heavyweight papers with the result that the coated paper displays a reduced tendency to crack at the fold while not adversely affecting other desirable paper properties, including printability. These binder materials will normally be applied, with pigment or a mixture of pigments, as all or part of the binder component of a coating formulation. These materials are also effective when applied without pigment as a clear size. Thus, according to the invention, reference to a "paper coating composition" refers to both pigmented coatings and clear sizes. The materials of this invention can be substituted for both starch and latex in an existing coating formulation in any proportion, but according to preferred methods all the latex binder may be replaced with the materials of this invention. In addition, some or all of the starch typically present in conventional size press coating compositions may be replaced by the materials of the invention.

Formulations containing the binder compositions of the invention can be used for precoating, that is, the first-down application of a coating to a paper substrate. This may then be followed by one or more additional coating applications on top of the precoat which may or may not contain these materials. Inclusion of these materials in the precoat provides a desirable improvement in crack at the fold even if none of these materials is included in top coats. Nevertheless, if the materials of the invention are included in top coats, further improvements in folding behavior can be expected.

Size press coating formulations which may be used according to the invention can be assembled from three groups of ingredients. These groups are pigments, binders, and functional additives. For clear size or clear coatings, pigment is normally omitted. Pigments useful for practice of the invention include clay, calcium carbonate, titanium dioxide, silica and silicates, satin white, aluminum trihydrate, plus others known in the art. Each of these pigments is available in many grades or forms. For example, clay is available in a wide range of particle sizes, as well as a calcined and delaminated form. Silica pigments are available as synthetic pigments in many different particle sizes and surface areas.

Binders include the synthetic/starch reaction products and blends described above as well as starches, modified starches, polymer latex emulsions, polyvinyl alcohol, protein from vegetable and animal sources, and other dispersed or water soluble polymers. A wide variety of functional additives, known to those skilled in the art, may be optionally included in formulation with these materials. These additives may be used to provide viscosity control, lubrication, brightness when exposed to ultraviolet light, an insolubilization or cross linking effect, and other properties.

Typical ranges of ingredients in clear sizes or clear coatings are 80–100 parts binder and 0–20 parts additives, by weight. Clear sizes are typically used at solids contents of 5–30%. Typical ranges of ingredients in pigmented sizes or pigmented coatings are 100 parts pigment, 10–400 parts binder, and 0–10 parts additives. Pigmented sizes can be used at solids contents of about 10–70%. A preferred precoat formulation consists of 35 parts Pensize® 630 styrene-butadiene starch copolymer, 65 parts modified hydroxyethyl starch, and 25 parts ground limestone pigment. Depending on the specific application method and desired coat weight, these ranges can be broadened as necessary. Normally as solid content increases, the binder requirement decreases so that low solids formulations are usually rich in binder, and higher solids formulations contain reduced amounts of binder. As the solid content of these formulations is increased, viscosity typically increases also. On conventional size presses, viscosity is normally limited to less than 500 mPa.s, more commonly to less than 100 mPa.s, to maintain steady conditions in the flooded size press nip. On premetering size presses which do not have a flooded nip, viscosity can be higher, typically up to about 2000 mPa.s. Once the viscosity limitation of any particular application method has been reached, it is very difficult to move to higher coat weight by further increasing solids. A formulation change is normally made to reduce viscosity. The materials useful for practice of the present invention are particularly effective in that they allow increases in formulation solids without large increases in viscosity, thus allowing higher coat weight to be achieved.

The application of the coating formulation to mediumweight and heavyweight papers can be made using any of the size press apparatus and methods known in the art. By size press is meant a device in which a coating is applied to a nip through which the paper to be coated is run and includes any of conventional two-roll size press, flooded nip size press, or premetering size press (also known as a metered film applicator) in which a wet film of coating is first metered onto an applicator roll, then transferred to the paper surface. Particularly useful size presses for use according to the invention include that of the Voith Speedsizer® design and that of the Valmet Sym-Sizer.

The premetering size press is particularly effective when applying high solid content coatings, but can be used with a wide range of solids contents. Formulations containing conventional latex and starch binders may be limited in solid content by the viscosity of the starch. Formulations containing a high proportion of latex binders typically show low viscosity at high solid content, but are prone to suffer from breakdown of the latex component during application on a paper machine. Because of favorable rheology and stability displayed by the reaction products and blends useful with the invention, they are particularly effective in high solids formulations, making application by a premetering size press an especially effective method of practicing the invention. Use of the invention in this way permits high solid content, and therefore high coat weight, applications requiring a relatively low binder content. In this way, the full potential of the premetering size press can be used to apply highly effective, economical coatings that show reduced tendency to cracking at the fold.

Following application of the wet coating, the paper so treated is dried to remove the water applied along with the coating solids. There are many ways to accomplish this water removal, some of which involve bringing the wet, coated paper into contact with heated surfaces such as the steam-heated cylindrical dryer cans that are a normal part of a paper machine. Other methods utilize non-contact drying, where heat energy is supplied to the wet paper via infrared radiation or by an impinging flow of heated air. Because size press coating is normally done in-line on a paper machine, the dryer configuration includes heated rotating dryer cans over which the paper is carried, and may optionally include infrared drying between the size press and the dryer cans. Stability of the materials cited in this invention plays an important role in maintaining productivity during drying by either contact or noncontact drying methods.

The following examples describe a number of trials conducted on commercial size press paper machines to determine the performance of papers coated according to the invention. These examples will serve to illustrate how these materials may be used to advantage in coating. Other variations of practice of the invention will occur to those skilled in the art, and these examples are not meant to limit the scope of the invention in any way.

EXAMPLE 1

This example compares substitution of a composition of the invention (Pensize® 630) with a conventional styrene-butadiene latex material as a replacement for a portion of starch in a pigmented precoat applied by a Voith Speedsize® premetering size press in a commercial paper machine trial. This trial took place at a coated paper mill on a paper machine making precoated base paper. The precoated base paper was then single or double coated on an off-line blade coater to produce a variety of mediumweight to heavyweight (70–100 lb. per ream) coated printing papers.

The conventional precoat formulation consisted of 100 dry parts mediumweight viscosity, modified hydroxyethyl starch and 25 dry parts of a coarse ground limestone pigment (Carbital® 35, ECC International), with water added to adjust solid content to 11–12%. This formulation was applied as a precoat using a Voith Speedsizer® premetering size press with a coat weight of approximately 2 dry lb. per side per ream.

The mill set up to run trials of modified precoat formulations to try to improve fold cracking. Each trial involved replacing a portion of the starch with other binders. The first trial involved replacing 5 parts of the starch with a conventional styrene-butadiene latex binder recommended by its manufacturer for a size press application. Mill operating personnel reported that replacement of 5 parts of starch by an equal dry weight of latex caused runnability problems on the premetering size press. These runnability problems were observed as stickiness developing on the applicator rolls and metering rods of the premetering size press. This trial was terminated soon after the runnability problems developed because of the loss in machine productivity.

In the second trial the method of the invention was practiced wherein 5 dry parts of a styrene-butadiene starch copolymer product (Pensize 630) was incorporated into the binder composition and as a consequence of the previous experience with the conventional styrene-butadiene latex the mill employed a very conservative approach in light of their adverse experience with the latex binder. This new formulation ran very cleanly, and caused no runnability problems. Because of the success of this initial trial more of the styrene-butadiene starch copolymer product according to the invention was gradually added to the precoat formulation as the trial progressed such that 10 parts (dry weight) and 15 parts of the styrene-butadiene starch copolymer product had been successfully added to the existing formulation. A continuation of the trial then removed parts of dry starch and increased the content of the styrene-butadiene starch copolymer product as set out in Table 1 below. A further continuation of the trial began where the first trial left off, and was extended to add additional Pensize® starch copolymer material while removing some of the starch.

TABLE 1

| Trial | Pigment (Carbital) Parts | Starch Parts | Starch Copolymer (Pensize 630 ®) Parts | Pigment/Binder Ratio |
|---|---|---|---|---|
| 2A | 25 | 100 | 0 | 1:4.0 |
| 2B | 25 | 100 | 5 | 1:4.2 |
| 2C | 25 | 100 | 10 | 1:4.4 |
| 2D | 25 | 100 | 15 | 1:4.6 |
| 2E | 25 | 100 | 15 | 1:4.6 |
| 2F | 25 | 85 | 15 | 1:4.0 |
| 2G | 25 | 80 | 20 | 1:4.0 |
| 2H | 25 | 75 | 25 | 1:4.0 |

The precoated paper produced in these trials was subsequently single or double top coated and finished by the mill following normal practice and was evaluated by printers for printability and tendency to crack at the fold. Some printers reported a significant improvement in fold crack, and responded favorably to this improved performance. In no case did crack at the fold performance deteriorate. In addition, the printing quality of these papers, as reported by the printers, had not been diminished in any way. Subsequent use of a precoat formulation consisting of 35 parts Pensize 630® styrene-butadiene starch copolymer, 65 parts modified hydroxyethyl starch, and 25 parts ground limestone pigment has been reported to result in a sharp reduction of poor fold crack performance.

EXAMPLE 2

This example presents the results of a crack at the fold test program carried out using a pilot scale premetering size press in which four different types of size press precoat formulations were applied to the same base paper using a lab scale premetering size press. These formulations were all unpigmented, clear sizes. The first condition was no surface treatment at all (i.e.,just base paper by itself.) The second condition was application of 6% solids, medium-high viscosity, modified hydroxyethyl starch, (Penford® Gum 260, Penford Products Co.). The third condition was application of 6% solids of a styrene-butadiene starch copolymer (Pensize 630®). The fourth condition was application of 6% solids lattices. The amount of each application was 1 dry pound per ream, except for the unsized control which had no surface application. No pigment was used in any of the formulations.

After precoating, papers made at all four conditions were then finished by double coating in a standard manner using various formulations selected by the researcher. Paper samples were subjected to a number of tests, including many relating to folding strength, fold cracking, and printability. These tests included those of "Vandercook Pick Test" wherein a test print is made on the paper using a Vandercook offset press, and the number of picks (bits of material removed from the surface by the tack force of the ink) is counted. A low count indicates good pick strength. "IGT pick strength" is a test for surface strength wherein a strip of paper is tested for surface strength using the IGT Printability tester. "Cosmetic fold" is a test wherein paper is folded in a standard manner and is visually rated for the appearance of crack at the fold. "Fold tear" is a test wherein a folded sample of paper is inserted into an Instron Tensile Tester in such a way that the force required to tear the paper along the fold can be measured. "Fold tensile" is a test wherein a folded sample of paper is placed in an Instron mechanical testing device in such a way that the force required to break the paper at the fold can be measured. These later two tests measure the residual strength of a piece of paper after folding.

The results are presented in Table 2 below using a comparative rating system from 0 to 3, in which a rating of 3 is the best, 0 the worst. A change of one numerical grade within one set of paper was said to be significant. Unsized paper gave good crack resistance, but was unacceptable for printing due to weak pick resistance and tensile strength. Because the normal mill size press treatment is starch, it may be viewed as the control for comparison of the other treatments. Latex gave the best overall performance as measured in these tests but was unsuitable for use in size press applications because of runnability issues which would severely interfere with machine productivity. Use of the Pensize 630 styrene-butadiene starch copolymer exhibited an attractive balance of properties. It significantly outperformed starch in all tests. In particular, the improvement in fold crack over starch was judged to be sufficient to significantly reduce the incidence of fold cracking in commercial use.

TABLE 2

| Condition | Vandercook | IGT | Cosmetic Fold | Fold Tear | Fold Tensile |
|---|---|---|---|---|---|
| Unsized | 0 | 0 | 2 | 2 | 0 |
| Starch | 1 | 1 | 0 | 0 | 1 |
| Styrene-butadiene starch copolymer (Pensize 630 ®) | 2 | 2 | 1 | 1 | 2 |
| Latex | 3 | 3 | 3 | 3 | 3 |

EXAMPLE 3

According to this example, a styrene-butadiene starch copolymer (Pensize 630®) was used to replace 75% of the starch used in a clear, unpigmented size formulation on a conventional flooded nip size press followed by double coating. Specifically, clear size application was carried out on a standard horizontal, two-roll, flooded nip size press. The normal formulation included enzyme thinned potato starch applied at the size press at about 7.5% solids. Functional additives included small amounts of optical brightener fluorescent dye, and sodium hydroxide to adjust pH. Size press add-on to the base paper was about 5 grams per square meter. The precoated paper was then double coated and finished. Using this standard precoat of clear starch, fold cracking performance of paper was unacceptable in that stacks of folded print signatures exhibited a cracked, rough edge along the fold.

A trial formulation was prepared in which 75% of the enzyme thinned potato starch was replaced by a styrene-butadiene starch copolymer (Pensize 630®). Overall percent solids and size press add-on targets were unchanged. Enough paper was treated with the trial formulation to produce two machine rolls of double coated, finished paper for print and fold crack testing by printers. Reports from the printers, indicated that the paper treated according to the methods of the invention showed significantly reduced fold cracking while maintaining print properties.

Numerous modifications and variations in the practice of the invention are expected to occur to those skilled in the art upon consideration of the presently preferred embodiments thereof. Consequently, the only limitations which should be placed upon the scope of the invention are those which appear in the appended claims.

What is claimed is:

1. A method of coating and folding paper characterized by a basis weight greater than 60 pounds per 3,300 square feet without scoring said paper comprising the steps of applying in a size press a paper coating composition comprising a binder which comprises a stable aqueous diversion comprising a water insoluble component and a water soluble component wherein:

(a) the water insoluble component comprises coalescable polymer particles which have a $T_g$ less than 55° C. and a majority of which have a particle size less than 1 micron; and (b) the water soluble component comprises a water soluble polymer capable of inhibiting coalescence of said polymer particles, or a water soluble polymer and a component capable of inhibiting coalescence of said polymer particles;

and wherein said water insoluble component comprises greater than 3% and less than 75% by weight of the binder solids and said water soluble component comprises greater than 25% and less than about 97% of said solids; and folding said paper without scoring.

2. The method of claim 1 wherein the binder is the product of a persulfate ion initiated reaction.

3. The method of claim 1 wherein said water soluble polymer is a hydrolyzed starch.

4. The method of claim I wherein said water soluble component comprises a starch hydrolyzate product having an intrinsic viscosity of less than 0.12 dl/g.

5. The method of claim 1 wherein said binder comprises a reaction product of styrene and butadiene.

6. The method of claim 5 wherein the ratio of styrene to butadiene is from 70:30 to 30:70 by weight.

7. The method of claim 1 wherein the ratio of water insoluble components to starch in said binder is from 30:70 to 70:30 by weight.

8. The method of claim 1 wherein said binder has a solids content of 40% by weight or, greater.

9. The method of claim 8 wherein said binder has a solids content of 50% by weight or greater.

10. The method of claim 1 wherein said paper coating composition comprises a binder and a pigment.

11. The method of claim 1 wherein said paper is characterized by a basis weight of greater than 80 pounds per 3,300 square feet.

12. The method of claim 1 which is precoating.

13. The method of claim 1 which is topcoating.

14. Paper coated and folded according to the method of claim 1.

15. Coated paper according to claim 14 which is characterized by a basis weight of greater than 80 pounds per 3,300 square feet.

* * * * *